US007588062B1

(12) United States Patent
Green

(10) Patent No.: US 7,588,062 B1
(45) Date of Patent: Sep. 15, 2009

(54) CANDY POWDER DISPENSING APPARATUS

(76) Inventor: Scott David Green, 604 Ridge Rd., Birmingham, AL (US) 35206

( * ) Notice: Subject to any disclaimer, the term of this patent is extended or adjusted under 35 U.S.C. 154(b) by 425 days.

(21) Appl. No.: 11/476,375

(22) Filed: Jun. 28, 2006

(51) Int. Cl.
*B65B 1/04* (2006.01)

(52) U.S. Cl. ..... 141/362; 141/351; 141/360; 222/181.1

(58) Field of Classification Search ..... 141/2, 141/18, 351, 360–366; 222/181.1, 185.1
See application file for complete search history.

(56) References Cited

U.S. PATENT DOCUMENTS 2,128,488 A * 8/1938 Koerner ..... 141/360
3,254,802 A * 6/1966 Barnes ..... 222/181.2
3,822,032 A 7/1974 Vergobbi
3,923,085 A * 12/1975 Nimer ..... 141/261
5,480,063 A 1/1996 Keyes
5,542,412 A 8/1996 Century
5,725,131 A 3/1998 Bell et al.
6,047,746 A 4/2000 Green
6,253,959 B1 7/2001 Gaultney et al.
6,371,331 B1 4/2002 Gohde
6,619,510 B2 9/2003 Green
2007/0113924 A1 * 5/2007 Phillips, Jr. ..... 141/351

* cited by examiner

*Primary Examiner*—Timothy L Maust
(74) *Attorney, Agent, or Firm*—Kenneth M. Bush; Gerald M. Walsh; Bush Intellectual Property Law

(57) ABSTRACT

A dispensing apparatus having a chamber to hold granular or powdered materials, such as candy, and having a dispensing chute with a valve between the chamber and dispensing chute. The valve is biased in a closed position but can be opened by pushing a cam lever. The dispensing apparatus has guide arms to hold a collecting tube so that the collecting tube does not touch the dispensing chute. The guide arms also allow a user to open the valve to cause the candy to flow into the collecting tube by pushing the collecting tube against the cam lever which causes the valve to open.

11 Claims, 3 Drawing Sheets

CANDY POWDER DISPENSING APPARATUS

BACKGROUND OF THE INVENTION

1. Field of the Invention

The present invention relates to the field of dispensing granular or powdered materials and, more particularly, to devices for dispensing granular or powdered candy.

2. Technical Background

Devices are known for filling receptacles with granular, particulate, and/or powdered materials which are transported from containers into the receptacles. Dispensing mechanisms for these devices range from open containers with scoops to coin operated machines. Granular matter, such as sand, can be provided in various colors and can be dispensed from storage containers to produce a decorative art form in a transparent receptacle. Granular food products such as candy can also be dispensed by a user to fashion a creative decorative edible art form in a clear container. Granular or powdered food products need special care to avoid contamination. Thus, there is a need for a dispensing unit for granular food materials that will reduce contamination between the dispensing mechanism and the receptacles that receive the granular food material.

SUMMARY OF THE INVENTION

The present invention is a dispensing apparatus for granular or powdered food having a chamber for holding the food material. Between the bottom of the chamber and a dispensing chute is a valve having an opening which allows the food material to flow from the bottom of the chamber into the dispensing chute. The opening in the valve is biased away from the bottom of the chamber so that the food material will not flow from the bottom of the chamber into the dispensing chute. Below the dispensing chute are tube guides to hold a collection tube so that it does not contact the dispensing chute. The tube guides allow the collection tube to be pushed by a user against an activation plate. As the activation plate is pushed it moves a rod against a cam lever which pushes the valve so that the opening in the valve is aligned with the bottom of the chamber and the food material can flow from the food chamber, through the opening, into the dispensing chute, and then into the collection tube. When the collection tube is pulled away from the activation plate, the opening in the valve will move away from the bottom of the chamber and the dispensing chute and food material will no longer flow out of the chamber.

An advantage of the present invention is a granular powdered food dispenser that prevents contamination between the dispensing chute and the collection tube.

Another advantage is a food dispenser with a chamber that can be supplied by bottles filled with granular or powdered food.

Another advantage is the ability to combine several food dispensers to provide as many colors and flavors of candy as desired.

Another advantage is the use of a simple and durable valve and cam lever to open and close the channel between the food chamber and dispensing chute by pushing a collection tube against an activation plate.

DETAILED DESCRIPTION OF THE PREFERRED EMBODIMENT

While the following description details the preferred embodiment of the present invention, it is to be understood that the invention is not limited in its application to the details of construction and arrangement of the parts illustrated in the accompanying drawings, since the invention is capable of other embodiments and of being practiced in various ways.

Figure 1:
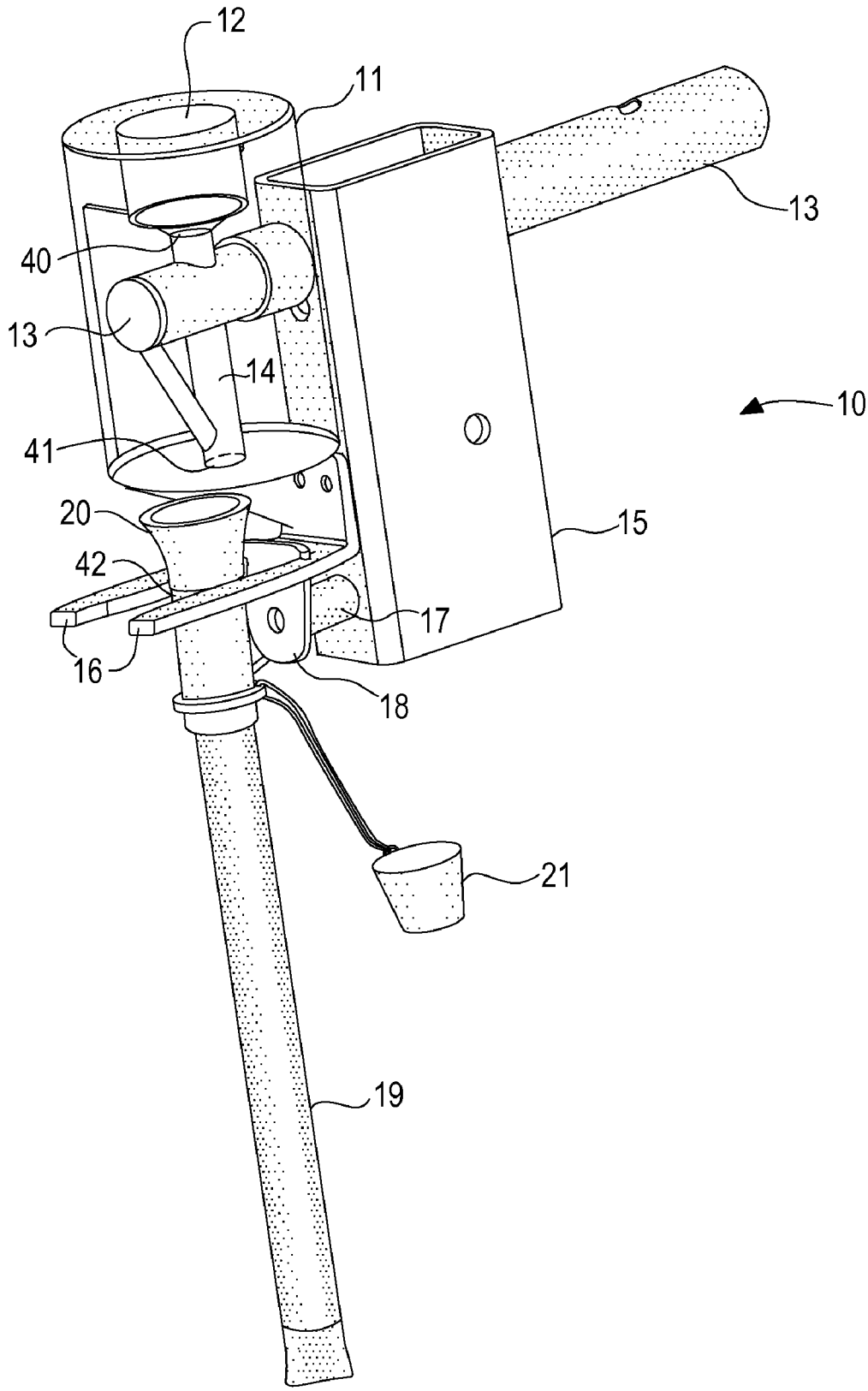
FIG. 1 shows a perspective view of the food dispenser of the present invention.

FIG. 1 shows a perspective view of the food dispensing apparatus 10 of the present invention. Dispensing apparatus 10 has a first housing 11 with a chamber 12 for holding granulated or powdered food materials such as, for example, powdered or granulated candy of any desired color and flavor. The bottom of the chamber 12 has drain opening 40 connected to a shaft 13. A dispensing chute 14 extends downward from shaft 13. Inside shaft 13 is a valve 30 (see FIG. 2) which controls the flow of food material from the bottom of chamber 12 into dispensing chute 14. First housing 11 is attached to a second housing 15. Guide arms 16 are attached to second housing 15 below first housing 11. Guide arms 16 allow the insertion of a collection tube 19. The guide arms 16 engage an annular groove 42 in collection tube 19 to hold collection tube 19 in place, preventing it from contacting the tip 41 of dispensing chute 14. Collection tube 19 can have a funnel 20 and plug 21 for insertion into funnel 20. Second housing 15 has a rod 17 having one end which engages a cam lever 35 inside second housing 15 (see FIG. 2). The opposite end of rod 17 has an activation plate 18. Collection tube 19 can be pushed along guide arms 16 so that it contacts activation plate 18. Collection tube 19 can be further pushed against activation plate 18 so that rod 17 is pushed into housing 15, thereby engaging cam lever 35. As rod 17 pushes cam lever 35, valve 30 opens and food material can pass through the drain opening 40, through valve 30, through dispensing chute 14, and into collection tube 19. As collection tube 19 is removed from activation plate 18 valve 30 closes.

Figure 2:
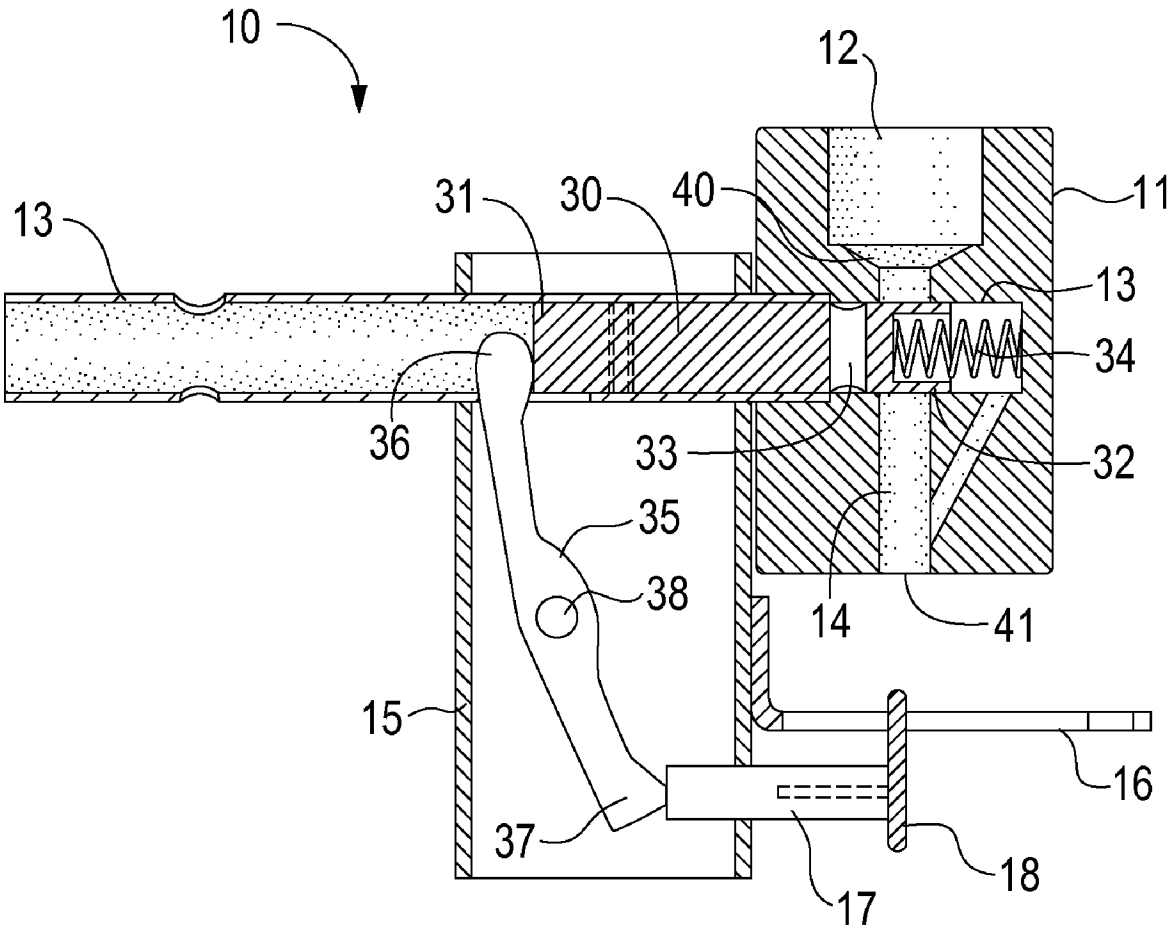
FIG. 2 shows a cross-sectional side view of the food dispenser with the valve in a closed position.

FIG. 2 illustrates a cross-sectional side view of food dispensing apparatus 10. Shaft 13 extends through housing 11 and housing 15. Within shaft 13 is valve 30. Valve 30 has a base 31 on one end and a head 32 on the other end. Near the head end 32 is an opening 33 that passes through valve 30. There is a spring 34 in the head end 32 to bias opening 33 away from drain opening 40 at the bottom of chamber 12 and away from dispensing chute 14. When valve opening 33 is, thus, not in alignment with drain opening 40 and dispensing chute 14, food material will not flow from chamber 12 through dispensing chute 14.

A cam lever 35 is contained within second housing 15 and is mounted rotatably to housing 15 by pin 38. Cam lever 35 has a first end 36 and an opposite end 37. First end 36 is contained within shaft 13 and engages the base 31 of valve 30.

Figure 3:
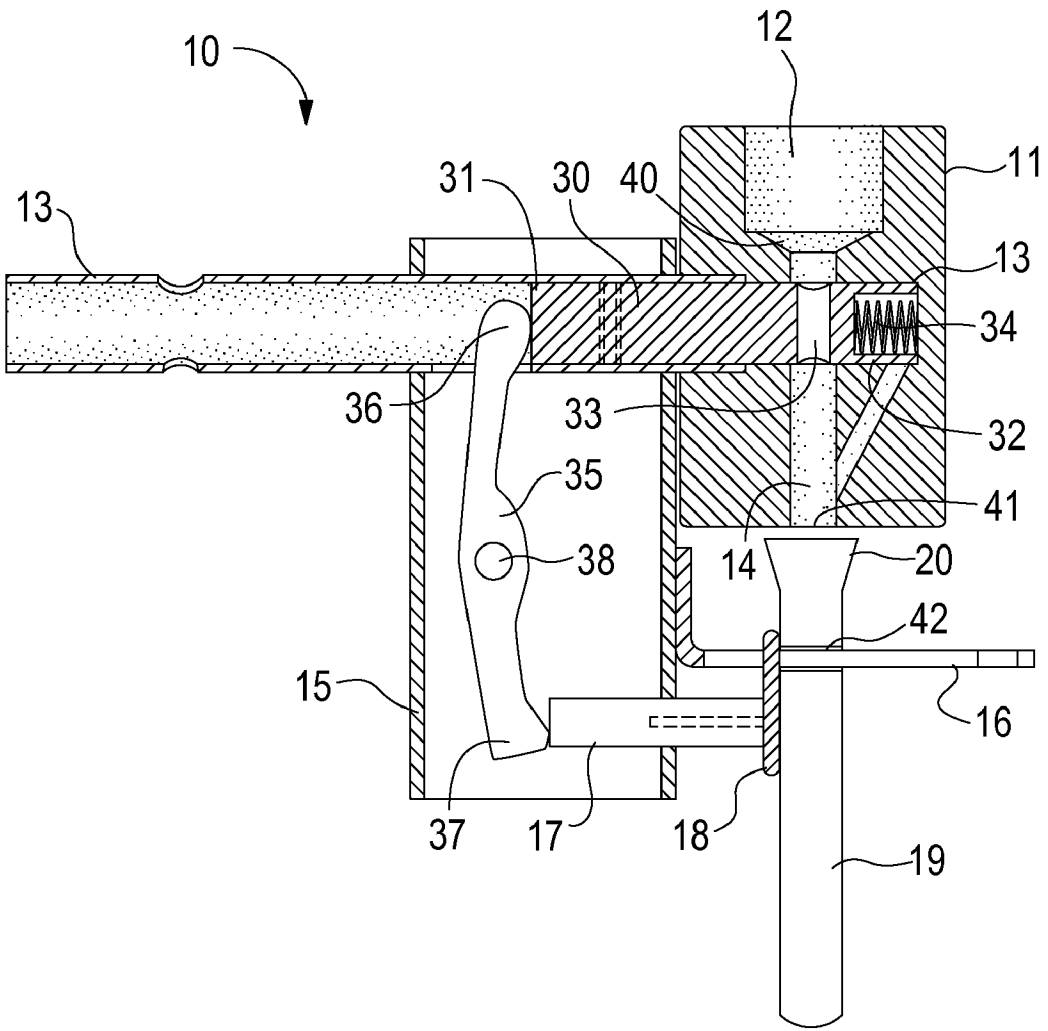
FIG. 3 shows a cross-sectional view of the food dispenser with the valve in an open position.

The opposite end 37 of cam lever 35 engages rod 17. As shown in FIG. 3 as rod 17 is pushed into second housing 15 by pushing on activation plate 18 with collection tube 19, cam lever 35 rotates about pin 38 and first end 36 of cam lever 35 pushes valve 30 along shaft 13, compressing spring 34 and aligning valve opening 33 with drain opening 40 and dispensing chute 14. When valve opening 33 is aligned with drain opening 40 and dispensing chute 14, food material will flow from the chamber 12, through valve opening 33, through dispensing chute 14, and into collection tube 19. When collection tube 19 is no longer pushed against activation plate 18, spring 34 will push valve 30 along shaft 13 so that valve opening 33 is no longer aligned with drain opening 40 and dispensing chute 14, thereby shutting off flow from food chamber 12.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the chamber can be constructed to accommodate any kind of filling device such as bottles, jars, or automatic filling systems. An unlimited number of units of the dispensing apparatus of the present invention can be arranged in various ways as desired to provide a variety of colored food substances for filling a collection tube.

It will be understood that various changes in the details, materials, and arrangements of the parts which have been described and illustrated above in order to explain the nature of this invention may be made by those skilled in the art without departing from the principle and scope of the invention as recited in the following claims.

The invention claimed is:

1. A dispensing apparatus for granular or powdered materials, comprising:

a) a chamber for holding said granular or powdered materials;

b) a dispensing chute;

c) a valve between said chamber and said dispensing chute;

d) said valve having an opening connecting said chamber with said dispensing chute when said valve opening is in alignment with said chamber and said dispensing chute;

e) said valve being biased so that said valve opening is not in alignment with said chamber and said dispensing chute;

f) a cam lever that pushes said valve opening into alignment with said chamber and said dispensing chute so that said granular powdered materials will flow from said chamber through said dispensing chute; and g) a rod which is pushed by a user to push said cam lever so that said cam lever pushes said valve opening into alignment with said chamber and said dispensing chute.

2. The dispensing apparatus of claim 1, further comprising guide arms which hold a collecting tube so that said collecting tube does not contact said dispensing chute.

3. The dispensing apparatus of claim 1, further comprising a shaft to contain said valve and to contain a portion of said cam lever.

4. The dispensing apparatus of claim 2 wherein said guide arms engage said collecting tube so that said collecting tube is pushed by a user to push said cam lever causing said cam lever to push said valve opening into alignment with said chamber and said dispensing chute.

5. A dispensing apparatus for granular or powdered materials, comprising:

a) a chamber for holding said granular or powdered materials;

b) a dispensing chute;

c) a valve between said chamber and said dispensing chute;

d) said valve having an opening connecting said chamber with said dispensing chute when said valve opening is in alignment with said chamber and said dispensing chute;

e) said valve being biased so that said valve opening is not in alignment with said chamber and said dispensing chute;

f) a cam lever that pushes said valve opening into alignment with said chamber and said dispensing chute so that said granular powdered materials will flow from said chamber through said dispensing chute;

g) guide arms which hold a collecting tube so that said collecting tube does not contact said dispensing chute; and h) a rod which is pushed by a user to push said cam lever so that said cam lever pushes said valve opening into alignment with said chamber and said dispensing chute.

6. The dispensing apparatus of claim 5, further comprising a shaft to contain said valve and to contain a portion of said cam lever.

7. The dispensing apparatus of claim 5 wherein said guide arms engage said collecting tube so that said collecting tube is pushed by a user to push said cam lever causing said cam lever to push said valve opening into alignment with said chamber and said dispensing chute.

8. A dispensing apparatus for granular or powdered materials, comprising:

a) a chamber for holding said granular or powdered materials;

b) a dispensing chute;

c) a valve between said chamber and said dispensing chute;

d) said valve having an opening connecting said chamber with said dispensing chute when said valve opening is in alignment with said chamber and said dispensing chute;

e) said valve being biased so that said valve opening is not in alignment with said chamber and said dispensing chute;

f) a cam lever that pushes said valve opening into alignment with said chamber and said dispensing chute so that said granular powdered materials will flow from said chamber through said dispensing chute;

g) guide arms which hold a collecting tube so that said collecting tube does not contact said dispensing chute;

h) a rod which is pushed by a user to push said cam lever so that said cam lever pushes said valve opening into alignment with said chamber and said dispensing chute;

i) a shaft to contain said valve and to contain a portion of said cam lever; and j) said guide arms engaging said collecting tube so that said collecting tube is pushed by a user to push said cam lever causing said cam lever to push said valve opening into alignment with said chamber and said dispensing chute.

9. A dispensing apparatus for granular or powdered materials, comprising:

a) a chamber for holding said granular or powdered materials;

b) a dispensing chute;

c) a valve between said chamber and said dispensing chute, wherein said valve has an opening connecting said chamber with said dispensing chute when said valve opening is in alignment with said chamber and said dispensing chute, wherein said valve is biased so that said valve opening is not in alignment with said chamber and said dispensing chute;

d) a rotatable cam lever operable to push said valve opening into alignment with said chamber and said dispensing chute so that said granular powdered materials will flow from said chamber through said dispensing chute, wherein said cam lever has an upper end and a lower end; and e) a rod operable to push said lower end of said cam lever such that said upper end of said cam lever is rotated to engage said valve and push said valve opening into alignment with said chamber and said dispensing chute.

10. The dispensing apparatus of claim 9, further comprising guide arms which hold a collecting tube so that said collecting tube does not contact said dispensing chute.

11. The dispensing apparatus of claim 9, further comprising a shaft to contain said valve and to contain a portion of said cam lever.

* * * * *